US007104839B2

(12) United States Patent
Henningsen

(10) Patent No.: US 7,104,839 B2
(45) **Date of Patent: *Sep. 12, 2006**

(54) COAXIAL CONNECTOR WITH CENTER CONDUCTOR SEIZURE

(75) Inventor: Jimmy Ciesla Henningsen, Holmegaard (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/253,122

(22) Filed: Oct. 17, 2005

(65) Prior Publication Data

US 2006/0040552 A1 Feb. 23, 2006

Related U.S. Application Data

(63) Continuation of application No. 10/869,105, filed on Jun. 15, 2004, now Pat. No. 6,955,562.

(51) Int. Cl.
*H01R 9/05* (2006.01)

(52) U.S. Cl. ..... 439/578; 439/584

(58) Field of Classification Search ..... 439/578–585
See application file for complete search history.

(56) References Cited

U.S. PATENT DOCUMENTS

| | | | | |
|---|---|---|---|---|
| 3,040,288 | A | 6/1962 | Edlen et al. | 339/103 |
| 3,199,061 | A | 8/1965 | Johnson et al. | 339/100 |
| 3,264,602 | A | 8/1966 | Schwartz | 339/177 |
| 3,291,895 | A | 12/1966 | Van Dyke | 174/88 |
| 3,320,575 | A | 5/1967 | Brown et al. | 339/268 |
| 3,675,181 | A | 7/1972 | Lankford et al. | 339/32 R |
| 3,678,446 | A | 7/1972 | Siebelist | 339/177 E |
| 3,757,279 | A | 9/1973 | Winston | 339/177 R |
| 3,829,800 | A | 8/1974 | Spinner | 333/97 R |
| 3,963,321 | A | 6/1976 | Burger et al. | 339/177 E |
| 4,046,451 | A | 9/1977 | Juds et al. | 339/177 R |
| 4,126,372 | A | 11/1978 | Hashimoto et al. | 339/177 E |
| 4,135,776 | A | 1/1979 | Ailawadhi et al. | 339/177 R |
| 4,236,188 | A | 11/1980 | Prochazka | 361/111 |
| 4,241,973 | A | 12/1980 | Mayer et al. | 339/143 R |
| 4,346,958 | A | 8/1982 | Blanchard | 339/177 R |
| 4,408,822 | A | 10/1983 | Nikitas | 339/177 R |
| 4,421,377 | A | 12/1983 | Spinner | 339/177 R |
| 4,496,208 | A | 1/1985 | Spinner et al. | 339/177 R |
| 4,676,577 | A | 6/1987 | Szegda | 439/584 |

(Continued)

FOREIGN PATENT DOCUMENTS

CH 690 946 A5 4/1996

(Continued)

*Primary Examiner*—Briggitte Hammond
*Assistant Examiner*—X. Chung-Trans
(74) *Attorney, Agent, or Firm*—Joseph M. Homa; Marvin A. Glazer

(57) ABSTRACT

A coaxial connector includes a removable back nut, an outer body, and a center conductor supported within the outer body by a dielectric. The center conductor includes a female socket for receiving an exposed inner conductor of a coaxial cable, and a compression member compresses the female socket to seize the inner conductor as the back nut is secured to the outer body. In use, a prepared end of a coaxial cable is inserted through the back nut, and the end portion of the outer conductor of the coaxial cable is flared outwardly. As the back nut is tightened onto the outer body, the flared end of the outer conductor is directly clamped between integral clamping surfaces of the back nut and outer body. As the back nut is tightened, the compression member simultaneously engages the female socket to seize the inner conductor.

16 Claims, 5 Drawing Sheets

U.S. PATENT DOCUMENTS

| | | | | |
|---|---|---|---|---|
| 4,687,272 | A | 8/1987 | Spinner et al. | 439/271 |
| 4,696,532 | A | 9/1987 | Mattis | 439/863 |
| 4,824,401 | A | 4/1989 | Spinner | 439/584 |
| 4,854,893 | A | 8/1989 | Morris | 439/578 |
| 4,923,412 | A | 5/1990 | Morris | 439/578 |
| 4,952,174 | A | 8/1990 | Sucht et al. | 439/584 |
| 5,011,432 | A | 4/1991 | Sucht et al. | 439/584 |
| 5,137,470 | A | 8/1992 | Doles | 439/578 |
| 5,137,471 | A | 8/1992 | Verespej et al. | 439/585 |
| 5,154,636 | A | 10/1992 | Vaccaro et al. | 439/583 |
| 5,166,477 | A | 11/1992 | Perin, Jr. et al. | 174/74 R |
| 5,167,533 | A | 12/1992 | Rauwolf | 439/583 |
| 5,284,449 | A | 2/1994 | Vaccaro | 439/583 |
| 5,352,134 | A | 10/1994 | Jacobsen et al. | 439/584 |
| 5,354,217 | A | 10/1994 | Gabel et al. | 439/583 |
| 5,518,420 | A | 5/1996 | Pitschi | 439/578 |
| 5,595,502 | A | 1/1997 | Allison | 439/429 |
| 5,651,698 | A | 7/1997 | Locati et al. | 439/578 |
| 5,766,037 | A | 6/1998 | Nelson | 439/583 |
| 5,769,662 | A | 6/1998 | Stabile et al. | 439/578 |
| 5,795,188 | A | 8/1998 | Harwath | 439/583 |
| 5,830,009 | A | 11/1998 | Tettinger | 439/578 |
| 5,857,872 | A | 1/1999 | Tettinger | 439/584 |
| 5,871,372 | A | 2/1999 | Kanda et al. | 439/583 |
| 5,984,723 | A | 11/1999 | Wild | 439/583 |
| 5,993,254 | A | 11/1999 | Pitschi et al. | 439/584 |
| 6,019,635 | A | 2/2000 | Nelson | 439/583 |
| 6,019,636 | A | 2/2000 | Langham | 439/584 |
| 6,102,738 | A | 8/2000 | Macek et al. | 439/584 |
| 6,133,532 | A | 10/2000 | Lundbäck et al. | 174/88 |
| 6,148,513 | A | 11/2000 | Schiefer et al. | 29/858 |
| 6,183,298 | B1 | 2/2001 | Henningsen | 439/578 |
| 6,210,222 | B1 | 4/2001 | Langham et al. | 439/583 |
| 6,217,384 | B1 | 4/2001 | Strasser et al. | 439/583 |
| 6,267,621 | B1 | 7/2001 | Pitschi et al. | 439/584 |
| 6,309,251 | B1 | 10/2001 | Tang | 439/584 |
| 6,331,123 | B1 | 12/2001 | Rodrigues | 439/584 |
| 6,383,019 | B1 | 5/2002 | Wild | 439/578 |
| 6,439,924 | B1 | 8/2002 | Kooiman | 439/578 |
| 6,513,244 | B1 | 2/2003 | Andreescu | 30/90.2 |
| 6,592,403 | B1 | 7/2003 | Koiman | 439/578 |
| 6,607,398 | B1 | 8/2003 | Henningsen | 439/578 |
| 6,769,933 | B1 | 8/2004 | Bence et al. | 439/578 |
| 6,793,529 | B1 | 9/2004 | Buenz | 439/583 |
| 6,802,738 | B1 | 10/2004 | Henningsen | 439/583 |
| 6,802,739 | B1 | 10/2004 | Henningsen | 439/584 |
| 6,955,562 | B1 * | 10/2005 | Henningsen | 439/578 |
| 2005/0159043 | A1 | 7/2005 | Harwath et al. | 439/578 |
| 2005/0159044 | A1 | 7/2005 | Harwath et al. | 439/578 |

FOREIGN PATENT DOCUMENTS

| | | |
|---|---|---|
| DE | 900 364 | 12/1953 |
| DE | 1 905 182 | 9/1970 |
| DE | 4 020 326 | 1/1992 |
| DE | 298 00 824 | 4/1998 |
| EP | 0 757 408 | 2/1997 |
| EP | 1 122 835 | 8/2001 |
| EP | 1 148 592 | 10/2001 |
| EP | 1 376 773 | 1/2004 |
| EP | 1 028 498 | 11/2004 |
| EP | 1 303 005 | 3/2005 |
| EP | 1 303 010 | 4/2005 |
| GB | 1 421 215 | 1/1976 |
| GB | 2 298 971 | 9/1996 |
| WO | WO 2004/055943 | 7/2004 |
| WO | WO 2005/027276 | 3/2005 |

* cited by examiner

COAXIAL CONNECTOR WITH CENTER CONDUCTOR SEIZURE

This is a continuation of U.S. patent application Ser. No. 10/869,105 filed on Jun. 15, 2004 now U.S. Pat. No. 6,955,562, the content of which is relied upon and incorporated herein by reference in its entirety, and the benefit of priority under 35 U.S.C. §120 is hereby claimed.

TECHNICAL FIELD

The present invention relates generally to a coaxial connector for hardline coaxial cables, and more particularly, to a simplified coaxial connector and method of attachment of a coaxial cable to the coaxial connector.

BACKGROUND OF THE INVENTION

Hardline coaxial cables are widely used in the cable television industry to distribute cable television signals. Such cables include a central inner conductor surrounded by a low loss, high dielectric plastic foam. The foam dielectric is, in turn, surrounded by a metallic outer conductor which may be cylindrical or corrugated. A protective insulating jacket, or sheath, surrounds the metallic outer conductor and helps prevent moisture from degrading the signal path. The ends of such coaxial cables must be connected to junction boxes, amplifiers, and other coaxial ports, and coaxial connectors are well known for terminating the ends of hardline coaxial cables.

In order to properly transmit an electrical signal, a coaxial connector should ensure that a reliable electrical connection is achieved between the outer body of the connector and the outer conductor of the coaxial cable. Likewise, a suitable coaxial connector must achieve a reliable electrical connection between the center conductor of the connector and the inner conductor of the coaxial cable. In addition, reliable coaxial connectors must form a secure mechanical connection to the end of the coaxial cable, since mechanical separation of the connector from the end of the cable will interfere with successful transmission of the desired electrical signal.

Coaxial connectors are known which achieve secure electrical and mechanical coupling with the end of a coaxial cable. However, the complexity of such connectors, their relatively high parts count, and the burden imposed upon the technician during installation, are all significant for such known coaxial connectors.

Current hardline coaxial cable connectors on the market consist of a number of moving parts, typically a standard front end which includes an inner terminal or center conductor, an outer terminal or outer body, a dielectric insulator for supporting the center conductor within the outer body, and a moveable back nut which encapsulates a number of seals, retaining rings and the like. U.S. Pat. No. 6,133,532 shows one such connector having a back nut which encapsulates three different moving parts (a locking device, guide surface and inner sleeve) as well as three separate O-ring seals. The large number of moving parts in the back nut portion complicates the fitting of a coaxial cable which usually requires the use of several specialized tools. Additionally, the risk of connector malfunctioning and mounting problems increases with a higher number of moving parts, since there is a greater chance that at least one part may be defective, missing or incorrectly attached.

Likewise, U.S. Pat. No. 4,952,174 to Sucht, et al. discloses a coaxial connector wherein the back nut houses a cone, a mandrel, a mandrel shell, a tined ferrule, and a seal ring. The cone operates together with the center conductor of the connector to bite into the inner conductor of the coaxial cable. The tined ferrule bites into the outer surface of the outer conductor of the coaxial cable and forces such outer conductor against he mandrel. Apart from the relatively large number of parts, there is no direct contact between the outer conductor of the coaxial cable and the outer body of the connector.

Similarly, U.S. Pat. No. 4,676,577 to Szegda discloses a coaxial connector for use with hardline coaxial cable and including a front body, a center conductor supported within the front body and insulated therefrom, and a rear nut (or cap body). The center conductor of the front body includes a collet for receiving the inner conductor of the coaxial cable. An insulative seizure bushing is positioned within the front body to constrict the collet when the seizure bushing is axially displaced. The front body also includes a mandrel for being inserted into the coaxial cable just inside the outer conductor thereof; this mandrel is axially movable relative to the front body and engages the seizure bushing. The rear nut includes an outer conductor clamp member for gripping the outer surface of the coaxial cable outer conductor, as well as a clamp ring having a ramped surface and engaging an o-ring. As the rear nut is tightened onto the front body, the outer conductor clamp member engages a ramp on the front body causing the outer conductor clamp member to be radially compressed inwardly against the outer conductor of the coaxial cable; likewise, the outer conductor clamp member engages the ramped surface of the clamp ring, again forcing the outer conductor clamp member to be compressed against the outer conductor of the coaxial cable, while compressing the o-ring within the rear nut. Simultaneously, the outer conductor clamp member engages, and axially displaces, the mandrel and seizure bushing within the front body to constrict the center conductor collet.

U.S. Pat. No. 6,183,298 to Henningsen also discloses a hardline coaxial connector having a main body, a bushing or back nut, a center conductor, and an insulator supporting the center conductor within the main body. The Henningsen '298 patent includes an axially displaceable member for radially compressing the center conductor of the connector about the inner conductor of the cable. However, the back nut, or bushing, again contains additional movable parts, including a slotted ferrule, an inner bushing, and a friction reducing disk.

Due to the large number of moving parts encapsulated in the back nut of most conventional connectors, the outer conductor must be thoroughly cleared of all glue and adhesive material that may hinder or jam the parts during mounting and tightening, or a poor electrical connection may result. This process can prove to be quite difficult and time-consuming.

The manufacture and assembly of conventional connectors is also expensive in terms of time taken and material costs due to the number of parts enclosed in the back nut, which have to be manufactured and assembled.

Accordingly, it is an object of the present invention is to provide a simple, yet effective method of securely connecting a coaxial cable with either a corrugated (semi-rigid) or non-corrugated (rigid) outer conductor to a coaxial connector.

A further object of the invention is to provide an economic and effective coaxial connector for hardline coaxial cables.

Another object of the present invention is to provide such a coaxial connector which achieves both a secure electrical and mechanical attachment to both the outer conductor and inner conductor of the coaxial cable with a relatively small number of components.

Yet another object of the present invention is to provide such a coaxial connector wherein the back nut does not require any axially-slidable components.

A still further object of the present invention is to provide a connector having a simple design and a limited number of parts, thus reducing manufacturing expense, assembly time, and simplifying installation.

These and other objects of the present invention will become more apparent to those skilled in the art as the description of the present invention proceeds.

SUMMARY OF THE INVENTION

Briefly described, and in accordance with a preferred embodiment thereof, the present invention provides a connector consisting of a back nut, inner and outer terminals, and insulator. The back nut is made of a single tubular piece and does not enclose any further parts, except perhaps a sealing ring. In connecting a coaxial cable to the connector, the cable is inserted through the back nut, and a portion of the outer conductor at the end of the cable is flared and shaped along the back nut. The back nut is then axially displaced to clamp the end of the outer conductor of the coaxial cable between an outer terminal, or outer body, of the coaxial connector and the back nut. This process is very simple and easy to carry out, while greatly reducing the chances of errors and defects in assembly and mounting in comparison to conventional connectors.

The reduction in the number of parts also means that only an end portion of the outer conductor which comes into contact with the coaxial connector has to be stripped of glue and adhesive material. This is a much smaller area than required for conventional coaxial connectors.

According to one embodiment of the present invention, the procedure for mounting the coaxial connector to the end of the coaxial cable includes the steps of a) removing a portion of the insulating jacket from the end of the cable which is to be connected, thereby exposing an end portion of the outer conductor of the coaxial cable; b) removing a portion of the outer conductor and dielectric material from the end of the cable to be connected to expose an end portion of the inner conductor thereof; c) inserting the prepared end of the cable through the back nut; d) flaring the end of the outer conductor of the coaxial cable; e) placing the flared end of the outer conductor in a gap formed between opposing clamping faces formed on the outer body and back nut; and f) axially displacing the back nut toward the outer body, or front end, of the coaxial connector to clamp the flared end of the outer conductor between the corresponding clamping faces of the outer body and back nut of the coaxial connector.

The coaxial connector of the present invention includes a back nut having a central bore that includes a first annular clamping surface that is preferably integral therewith and adapted to engage the outer surface of the outer conductor of the coaxial cable proximate to the prepared end thereof. The coaxial connector further includes a generally tubular outer body having a central bore extending therethrough along a central axis between first and second ends. The first end of the outer body is adapted to be releasably secured to the back nut; in the preferred embodiment, both the first end of the outer body and the back nut include mating threaded portions adapted to engage each other. Ideally, an o-ring is disposed upon, and extends about, the outer body to engage the second end of the back nut when the back nut is tightened onto the first end of the outer body, thereby forming a leakproof seal between the back nut and outer body of the coaxial connector.

The first end of the outer body includes a second annular clamping surface, preferably integral therewith, for engaging the inner surface of the outer conductor of the coaxial cable. These first and second clamping surfaces collectively serve to clamp an exposed portion of the outer conductor of the coaxial cable therebetween as the back nut is tightened onto the first end of the outer body.

The second end of the front body may be either male or female. If the second end of the front body is female, then it preferably includes a front nut rotatably secured about the second end of the outer body, the front nut including an internally-threaded surface for mating with an externally-threaded mating component.

A dielectric insulator is disposed within the central bore of the outer body, and a center conductor extends through a central bore of the dielectric member and is supported thereby. A first end of the center conductor includes a compressible female socket opening toward the first end of the outer body for receiving and engaging the inner conductor of the coaxial cable. The center conductor also includes an opposing second end extending generally within the second end of the outer body.

In the preferred embodiment of the present invention, an electrically insulative seizure compressor is disposed within the first end of the outer body. One end of the seizure compressor is engaged by the outer conductor of the coaxial cable as the back nut is tightened onto the first end of the outer body. The other end of the seizure compressor engages the compressible female socket. As the back nut is tightened onto the first end of the outer body, the seizure compressor is axially displaced further into the outer body and compresses the female socket to seize the inner conductor of the coaxial cable.

Ideally, the central bore of the back nut includes a relatively smooth portion for sliding over the protective jacket of the coaxial cable; the inner diameter of such smooth portion is commensurate with the outer diameter of the protective jacket. Preferably, this smooth portion is bounded by an inner wall that includes an annular recess, and an O-ring is seated within such annular recess to form a seal between the central bore of the back nut and the protective jacket of the coaxial cable. As mentioned above, the central bore of the back nut also preferably includes a threaded portion for engaging a threaded outer surface formed upon the first end of the outer body. The threaded outer surface formed on the first end of the outer body is preferably inset relative to the second clamping surface formed on the first end of the outer body.

When practicing the preferred mode of the invention, an outwardly-flared lip is formed on the exposed end of the outer conductor of the coaxial cable. The first clamping surface formed within the central bore of the back nut is preferably an inwardly-directed annular step which engages the outer surface of such flared lip; preferably, the inwardly-directed annular step includes a beveled surface for engaging the outer surface of such flared lip. The second clamping surface of the first end of the outer body is angled and/or tapered for entering within the flared lip of the outer conductor of the coaxial cable, thereby engaging the inner surface thereof. The flared lip is clamped between such first and second clamping surfaces as the back nut is tightened onto the first end of the front body.

During attachment of the preferred coaxial connector to the prepared end of the coaxial cable, the back nut is removed from the first end of the front body of the connector, and the prepared end of the coaxial cable is inserted through the central bore of the back nut. The end portion of the outer conductor of the coaxial cable is flared outwardly, as described above to form the flared lip. The prepared end of the coaxial cable is then positioned proximate to the outer body of the coaxial connector to 1) engage the inner conductor of the coaxial cable with the female socket, 2) to place the second clamping surface at the first end of the outer body in close proximity to the flared lip of the outer conductor of the coaxial cable, and 3) to place the seizure compressor member in close proximity to the flared lip of the coaxial cable. The back nut is then tightened onto the first end of the outer body, as by rotating the back nut relative to the outer body to threadedly engage the two together; a portion of the flared lip of the outer conductor of the coaxial cable is firmly clamped between the clamping surfaces of the back nut and first end of the outer body. Simultaneously, the seizure compressor member is pushed by the flared lip into engagement with the female socket for seizing the inner conductor of the coaxial cable therein.

DETAILED DESCRIPTION OF THE INVENTION

Figure 1:
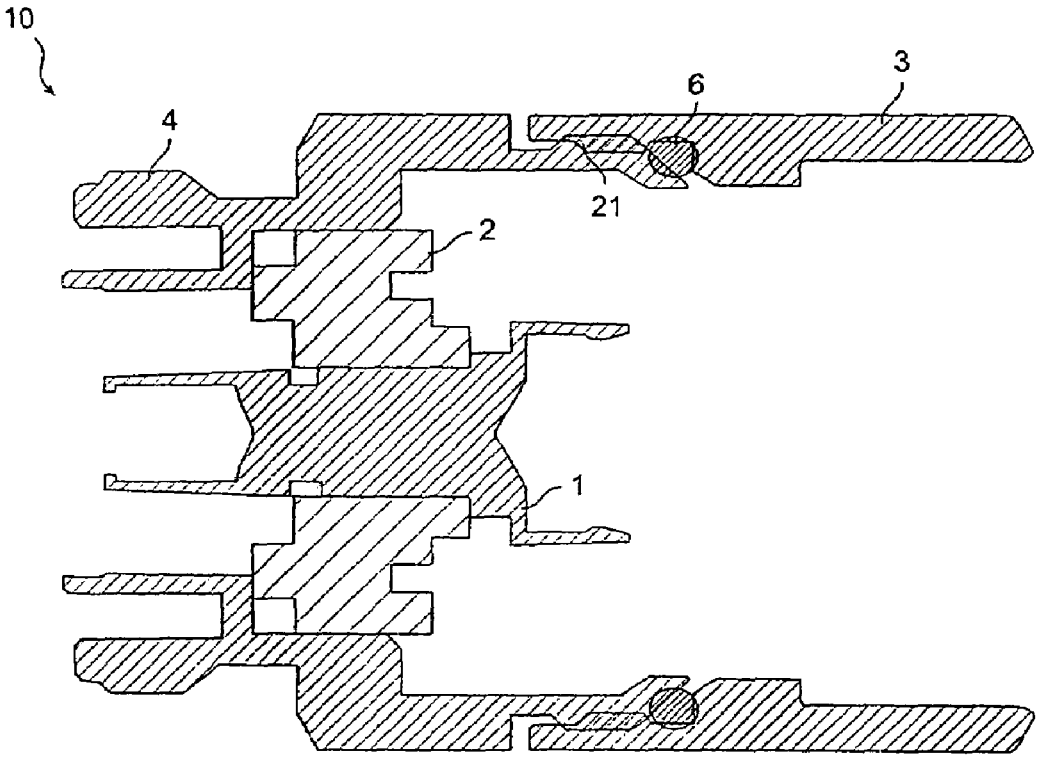
FIG. 1 is a sectional view of a connector, according to a preferred embodiment of the present invention.

FIG. 1 illustrates an embodiment of a connector 10 having an outer terminal 4, insulator 2 and inner terminal 1, which are rigidly attached to one another, and a back nut 3, which is rotatable and longitudinally displaceable along outer terminal 4, via mating threads 21. The inner terminal, back nut, and outer terminal are preferably made of brass. Other suitable materials include bronze for the inner terminal and plastic for the back nut. The insulator is press fit around the inner terminal and press fit into the outer terminal.

Figure 2:
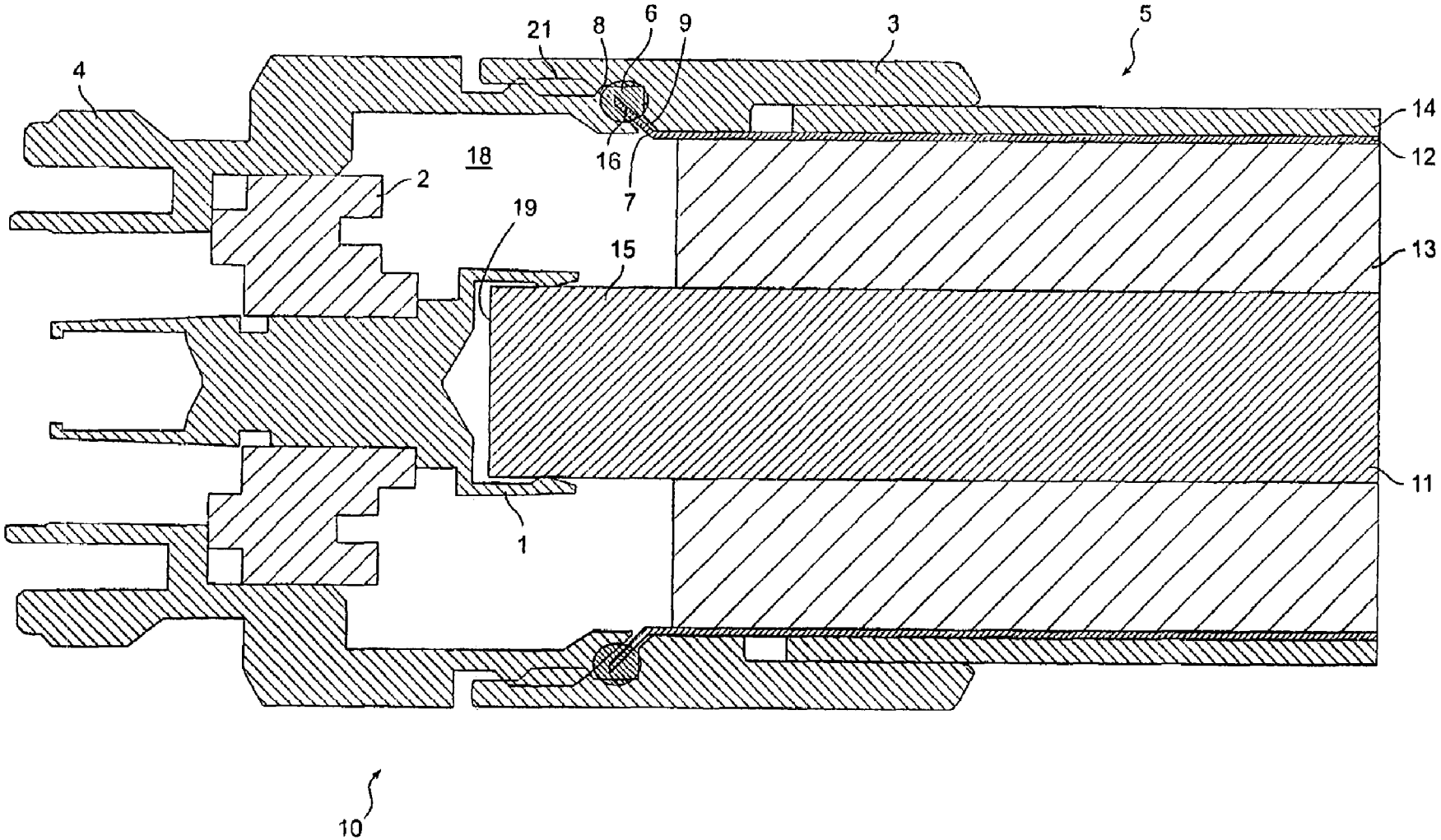
FIG. 2 is a sectional view of the connector of FIG. 1 mounted to a cable.

FIG. 2 illustrates connector 10 mounted to an end 19 of a cable 5, which includes inner and outer conductors 11 and 12, respectively, separated by a dielectric 13 and an outer insulating jacket 14. Outer conductor 12 is rigid, and may either be corrugated or smooth. An air space 18 is created between outer surfaces of the inner terminal and insulator, and inner surface of the outer terminal, and the end of the cable. This air space minimizes the loss through the connector at the connection between the connector and the cable, and provides about one-third the loss obtained with connectors having a corresponding dielectric filling.

In preparing cable 5 for mounting, a portion of the insulating jacket is removed from the end of the cable to expose a portion 7 of the outer conductor. A portion of the dielectric is then removed to expose a portion 15 of the inner conductor of coaxial cable 5. Preferably, the exposed outer conductor portion 7 is stripped and cleaned of any adhesive material that may have been used to secure the jacket about the outer conductor.

Figure 3:
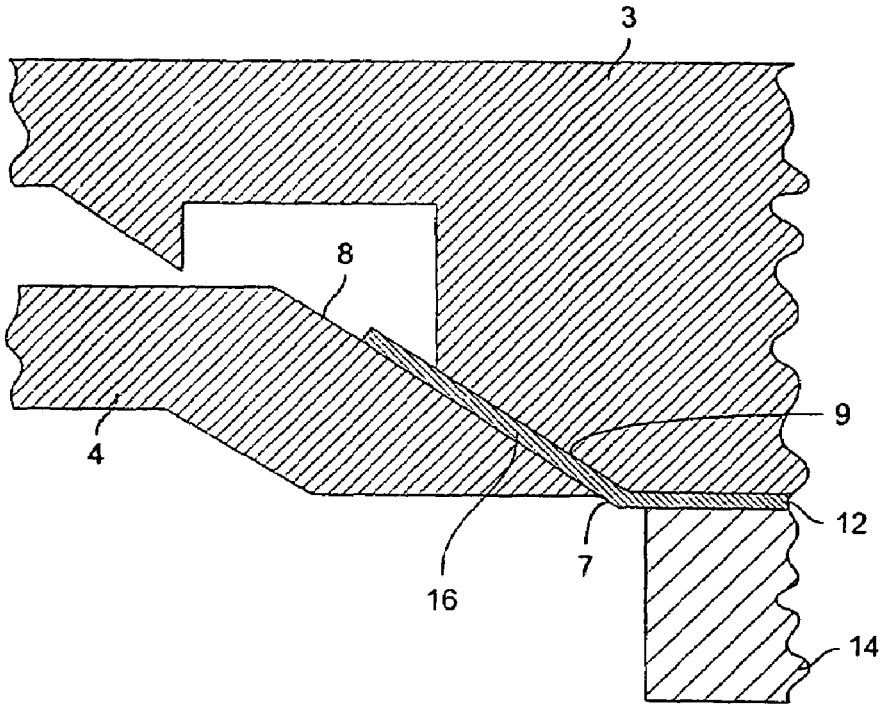
FIG. 3 is a view similar to FIG. 2, enlarged to show the attachment between an outer conductor portion of the cable and connector.

Connector 10 is shown with the exposed portion 15 of inner conductor 11 mounted and in contact with inner terminal 1 of the coaxial connector, while the stripped and cleaned outer conductor exposed portion 7 of cable 5 is positioned in a gap 16 formed between abutting faces, 8 and 9, respectively, of the outer terminal 4 and the back nut 3, respectively. The cable receiving face 9 of back nut 3 is a solid annular surface, not containing any slots or holes, in order to form a complete seal with, and make complete contact with, the outer surface of exposed portion 7 of the outer conductor 12 of cable 5. As shown in FIGS. 2 and 3, the outer conductor exposed portion 7 has been flared outwardly to create an enlarged-diameter lip. This flaring operation is performed after the exposed end of cable 5 has been inserted through the central aperture of back nut 3. Outward flaring of the outer conductor may be produced by using a flaring tool for enlarging the diameter of the exposed end of the outer conductor. This flared end, or enlarged-diameter lip, stops back nut 3 from slipping off the end of cable 5, and enables outer conductor exposed portion 7 to be clamped in gap 16, as shown in FIGS. 2 and 3. The length of flared portion 7 of the outer conductor is preferably less than the diameter of the cable, and more preferably, less than half the diameter of the cable; ideally, the length of the flared portion is less than one-fourth the diameter of the cable. An O-ring 6 is located within an annular groove in the back nut. When back nut 3 is threaded over outer terminal 4, O-ring 6 is compressed between faces 8 and 9 to ensure that moisture does not enter between outer terminal 4 and back nut 3; moisture ingress often interferes with reliable electrical contact within the connector.

FIG. 3 is an enlarged view of the connection between the outer terminal 4 and back nut 3 (for clarity, O-ring 6 is not shown). As shown in FIG. 3, the exposed end portion 7 of outer conductor 12 is stripped of its jacket 14. As is also shown in FIG. 3, a portion of dielectric material 13 inside the end of coaxial cable 5 has been removed to expose the inner surface of outer conductor 12. As shown in FIG. 3, the flared end portion 7 of outer conductor 12 is inserted into the gap between corresponding clamping faces 8 and 9. FIG. 3 shows end portion 7 of outer conductor 12 clamped between the back nut 3 and outer terminal 4, more specifically, between corresponding faces 8 and 9, ensuring a good mechanical connection, as well as a good electrical connection between outer conductor 12 and contact face 8 of outer terminal 4. Flared end portion 7 is compressed between back nut 3 and outer terminal 4 along the faces 8 and 9, which are angled, as shown in FIG. 3, such that the longitudinal displacement of the back nut toward the outer terminal (resulting from the tightening of back nut 3 over outer terminal 4) causes the outer conductor to be clamped. The frontmost portion of back nut 3 has internal threads formed therein; a corresponding portion of the outer terminal 4 has external threads formed thereupon for mating with the aforementioned internal threads of back nut 3.

Cable 5 is mounted to coaxial connector 10 as follows: first, the cable jacket 14 and dielectric material 13 are removed from the end of cable 5. The prepared end of cable 5 is then inserted through the central aperture of back nut 3. The exposed end of outer conductor portion 7 is then flared outwardly to a diameter which exceeds the smallest inner diameter of back nut 3, using the flaring tool described above. Any adhesive or glue remaining on the flared end of outer conductor portion 7 is removed. The end 19 of inner conductor 15 of coaxial cable 5 is then inserted into inner terminal 1 of connector 10, while simultaneously bringing flared outer conductor portion 7 into proximity with face 8 of outer terminal 4. Back nut 3 is then threadedly engaged over outer terminal 4 and screwed until there is a mechanical stop. Connector 10 is now reliably secured to the end of coaxial cable 5.

According to a second embodiment, the coaxial cable may be mounted to coaxial connector 10 without removing either jacket 14 or dielectric 13. The steps for mounting the cable to coaxial connector 10 according to this method, are as follows: first, an end portion of the cable is inserted through back nut 3. A tool is then used to pry the end portion of outer conductor 12 away from dielectric 13, and to flare the end of outer conductor 12 outwardly, as mentioned above. The inner conductor of the coaxial cable is then inserted into inner terminal 1 of the connector as described above, and back nut 3 is screwed over outer terminal 4 until there is a mechanical stop, leaving the end portion of the cable securely clamped between faces 8 and 9 of the outer terminal 4 and back nut 3. The cable can be mounted according to this method as long as there is a sufficient contact between the outer conductor portion 7 and face 8 of outer terminal 4.

According to a third embodiment, the cable is mounted by removing the dielectric within the exposed end of the coaxial cable, but not the cable jacket. This is a combination of the two previous embodiments. The steps for mounting the cable are as follows: first, a sufficient amount of dielectric material 13 is removed from the end portion of cable 5. The exposed end of coaxial cable 5 is then inserted through the central aperture of back nut 3. The end portion 7 of outer conductor 12 is again flared outwardly. The inner conductor 15 of coaxial cable 5 is then inserted into inner terminal 1 of connector 10, as described above. The back nut 3 is then longitudinally displaced, as by screwing back nut 3 onto outer terminal 4, so that the flared outer conductor and adjoined insulating jacket are clamped securely between the outer terminal's contact face 8 and the abutting back nut face 9.

Figure 4:
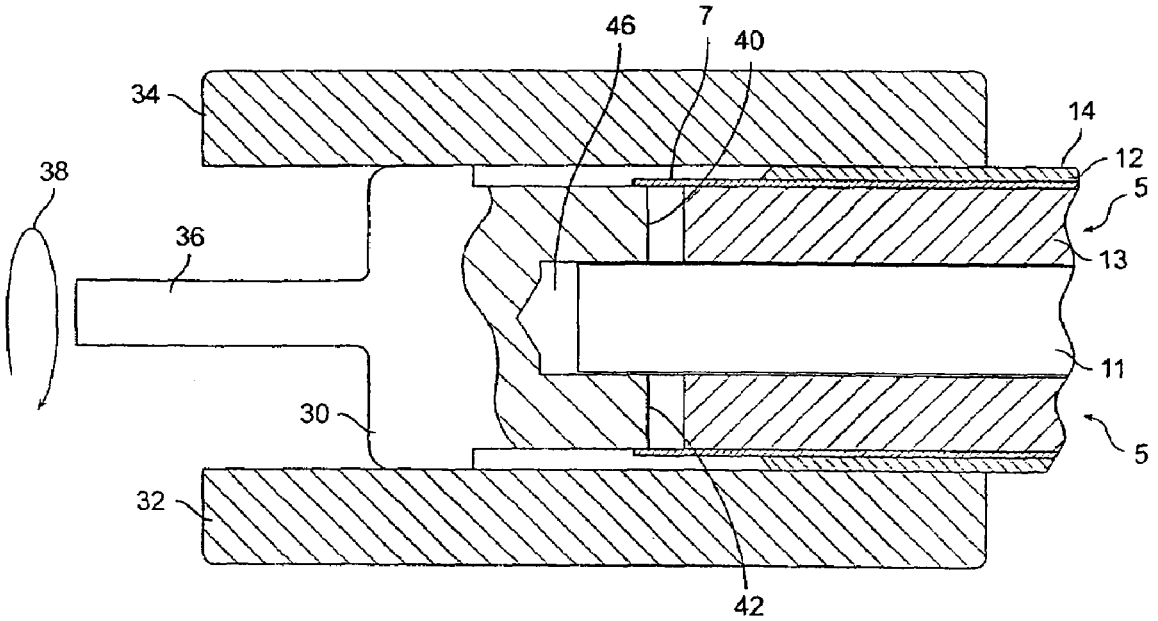
FIG. 4 is a cross-sectional view of a tool used to remove foam dielectric material at the end of a coaxial cable between the inner conductor and the outer conductor of the cable.

Turning to FIG. 4, a coring tool and cooperating collar are shown for removing foam dielectric from between the inner conductor 11 and outer conductor 12 of cable 5. Coring tool 30 includes a cylindrical shoulder region 32 for being rotatably supported within guide collar 34. Guide collar 34 has an inner diameter that matches the outer diameter of protective jacket 14 of cable 5; this allows guide collar 34 to be temporarily secured over the end of cable 5 during such coring operation. Coring tool 30 includes a stem 36 that can be rotated, as indicated by arrow 38, to operate coring tool 30. The working end of coring tool 30 includes cutting blades 40 and 42 which are of reduced diameter in comparison with shoulder 32 for fitting within outer conductor 12 of cable 5. As coring tool 30 is rotated, cutting blades 40 and 42 cut away dielectric foam material 13 disposed between inner conductor 11 and outer conductor 12. It will be noted that a central aperture 46 is formed between cutting blades 40 and 42. Central aperture 46 is of the same diameter as inner conductor 11 of cable 5 for allowing an exposed end of inner conductor 11 to extend therein during the coring operation. The sides of cutting blades 40 and 42 may also serve to remove dielectric foam material from the outer surface of inner conductor 11 and from the inner surface of outer conductor 12, leaving such surfaces shiny and clean to make good electrical contact.

Figure 5:
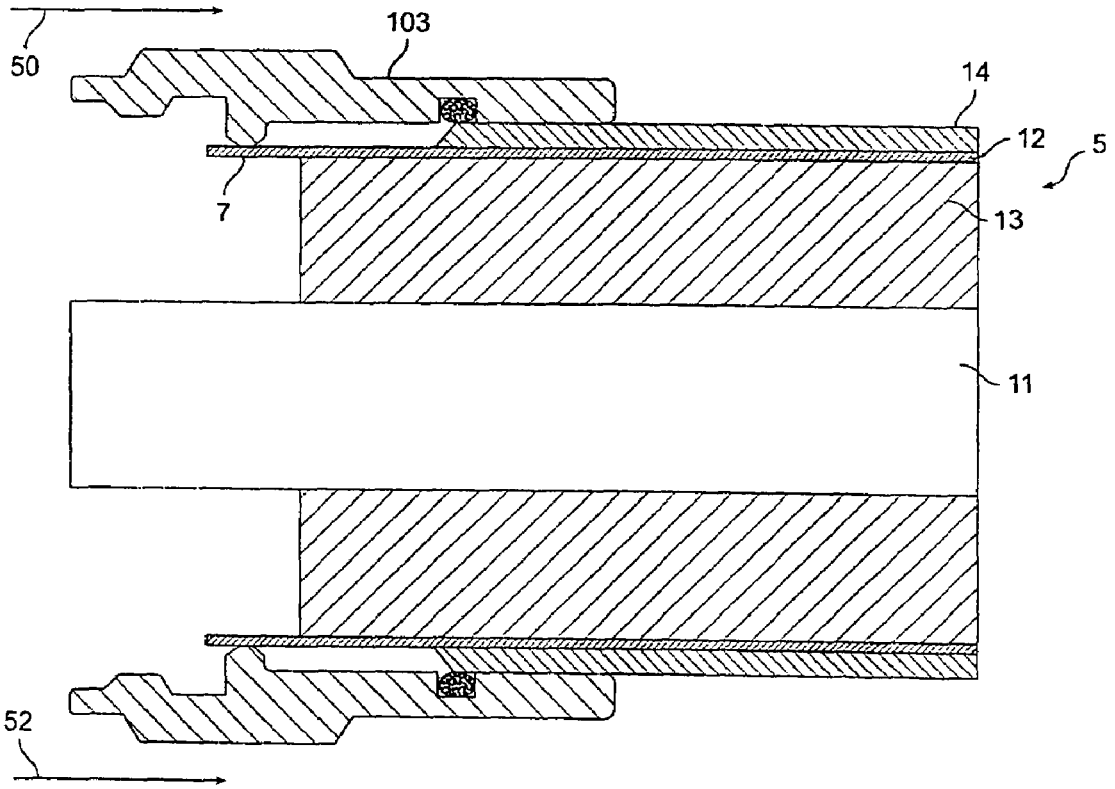
FIG. 5 is a cross-sectional view of a back nut sliding over the prepared end of the coaxial cable.

FIG. 5 shows the next step in the installation process, namely, sliding back nut 103 over the prepared end of cable 5. Back nut 103 is similar to back nut 3 already described in conjunction with FIGS. 1–3, but the construction of back nut 103 follows an alternate embodiment of the present invention described in greater detail below in conjunction with FIG. 7. Arrows 50 and 52 indicate that back nut 103 is being moved to the right, relative to the prepared end of cable 5 within FIG. 5.

Figure 6:
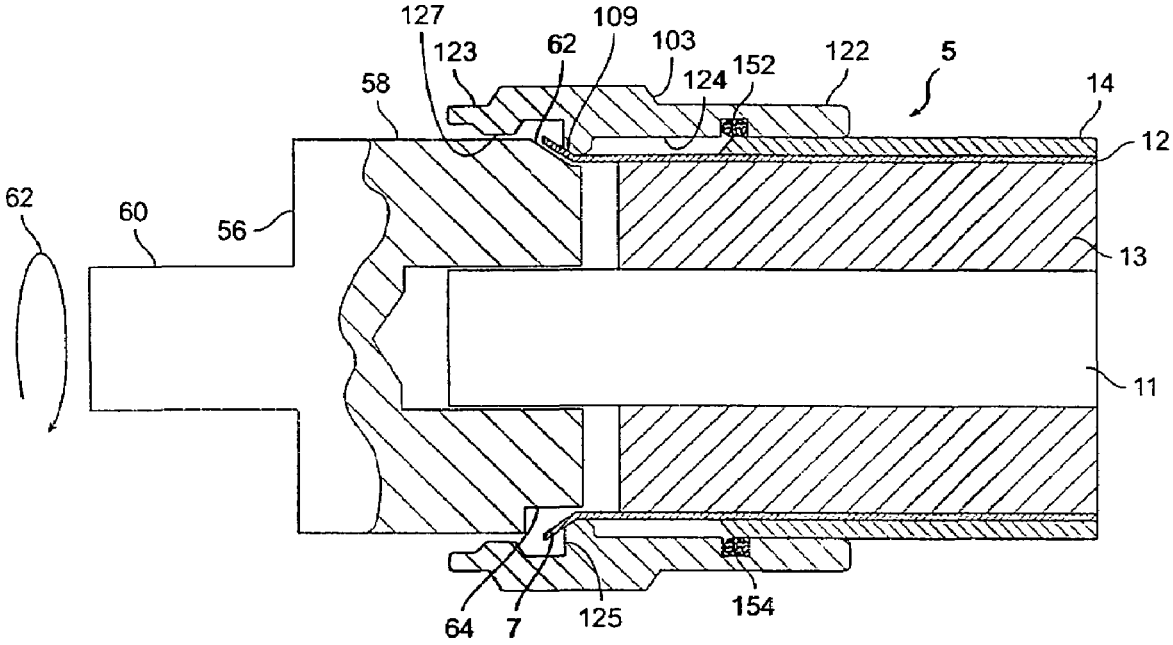
FIG. 6 is a cross-sectional view of a tool used to flare the end of the outer conductor of the coaxial cable to form an outwardly-flared lip.

Referring now to FIG. 6, a flaring tool is shown for outwardly flaring lip 7 of outer conductor 12 of cable 5. Flaring tool 56 is generally cylindrical and includes a shoulder region 58 that is of lesser diameter than the second end 123 of back nut 103. Flaring tool 56 includes a stem 60 adapted to be rotated by a user, as indicated by arrow 62. The working end of flaring tool 56 includes a beveled surface 62, the leading edge of which fits within outer conductor 12. Beveled surface 62 tapers outwardly to a larger diameter until joining shoulder region 58. It will be noted that beveled surface 62 does not extend completely around the working end of flaring tool 56; as shown in FIG. 6, a chamfer 64 is formed at a point located 180 degrees from beveled surface 62, and chamfer 64 fits within outer conductor 12 even before any flaring is effected. The user rotates flaring tool 56 while applying inward pressure thereto, and beveled surface 62 forces the exposed edge portion 7 of outer conductor 12 to be flared outwardly. As shown in FIG. 6, back nut 103 includes a beveled clamping surface 109 which may be brought to bear against the outer surface of exposed edge portion 7 during such flaring operation, thereby acting like a mandrel to help shape the flared edge portion 7. Beveled surface 62 of flaring tool 56 also may help to clean the inner surface of flared edge portion 7 of outer conductor 12.

Figure 7:
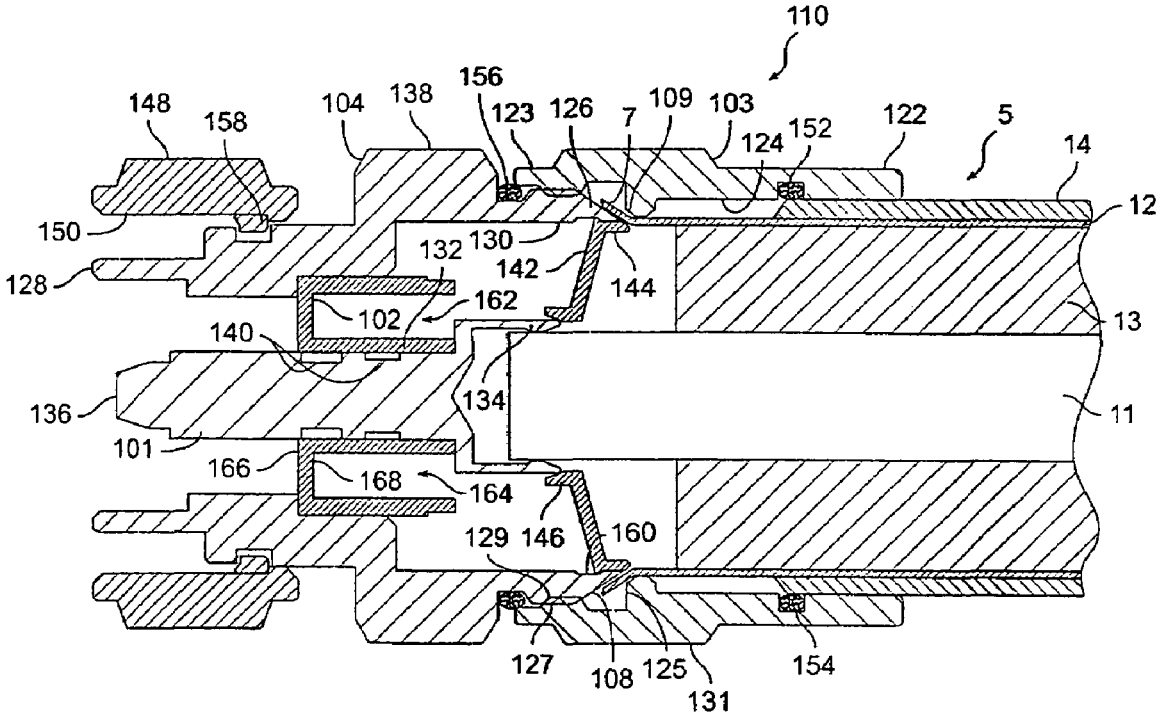
FIG. 7 is a cross-sectional view of the preferred embodiment of the coaxial connector, wherein the back nut is threadingly-engaged with the outer body of the connector, and wherein the flared lip of the outer conductor of the coaxial cable is axially displacing a seizure compressor member to cause seizure of the inner conductor of the coaxial cable.
Figure 8:
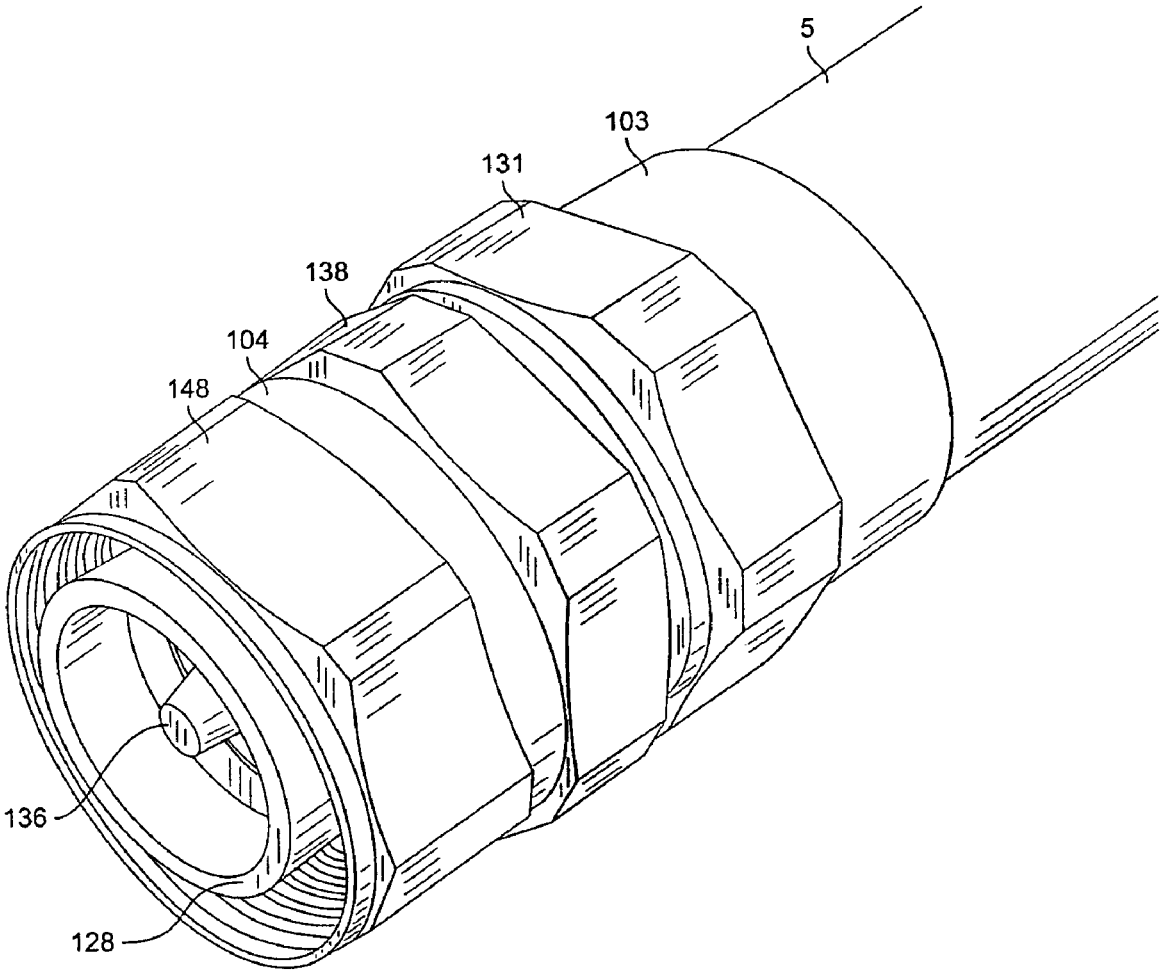
FIG. 8 is a perspective view of the coaxial connector assembly shown in FIG. 7 after installation has been completed.

FIG. 7 illustrates another preferred embodiment of the coaxial connector of the present invention. Coaxial connector 110 includes back nut 103 having an inner surface 124 defining a central bore extending between first end 122 and second end 123. Inner surface 124 of back nut 103 comprises a radially inwardly-directed annular step 125 having a first annular clamping surface 109 integral therewith and disposed between first end 122 and second end 123. First annular clamping surface 109 is preferably a beveled surface formed upon an edge of inwardly-directed annular step 125 which faces toward end 123. As shown in FIG. 7, annular clamping surface 109 engages the outer surface of flared lip portion 7 of outer conductor 12 proximate to the prepared end of coaxial cable 5. Back nut 103 is preferably made of machine-quality brass plated with a coating of NiTin-6. Inner surface 124 of back nut 103 includes a substantially constant diameter inner wall portion extending from annular step 125 to first end 122 for sliding over protective jacket 14 of coaxial cable 5.

This substantially constant diameter inner wall portion of central bore 124 has an inner diameter preferably commensurate with the outer diameter of protective jacket 14 of coaxial cable 5 to allow such substantially constant diameter inner wall portion to slide over jacket 14. The substantially constant diameter inner wall portion of back nut 103 has an annular recess 152 formed therein, and O-ring 154 is seated within annular recess 152 to form a seal between the inner wall of back nut 103 and protective jacket 14 of coaxial cable 5. Inner surface 124 of back nut 103 also includes a threaded portion disposed proximate second end 123; this threaded portion can be used to secure back nut 103 to the outer body of connector 110. The outer surface of back nut 103 includes a hexagonally-shaped region 131 to which a wrench may be applied when connector 110 is being installed.

Still referring to FIG. 7, connector 110 also includes a generally tubular outer body 104 extending between first end 126 and second end 128. Outer body 104 has an inner surface 130 defining a central bore extending therethrough along a central axis between first and second ends 126 and 128 thereof. First end 126 of outer body 104 is adapted to be releasably secured to second end 123 of back nut 103. Preferably, external threads are formed on outer surface 129 proximate first end 126 of outer body 104 for engaging and mating with threaded portion 127 of back nut 103. An o-ring 156 is disposed about the outer surface of outer body 104 axially closer to end 128 than threaded surface 129 and preferably adjacent thereto; o-ring 156 is adapted to sealingly engage against second end 123 of back nut 103 when back nut 103 is tightened onto first end 126 of outer body 104. Both o-ring 154 and bring 156 are preferably made of rubber compounds, more preferably ethylene propylene rubber, even more preferably a terpolymer such as Ethylene Propylene Diene Monomer (EPDM). EPDM is termed a terpolymer because it is comprised of three components (Ethylene, Propylene, and Diene). Alternatively, such o-rings could be made of silicone.

The outer surface of outer body 104 at first end 126 also includes a second annular clamping surface 108 integral therewith for engaging the inner surface of flared edge portion 7 of outer conductor 12 of coaxial cable 5. Second clamping surface 108 is preferably tapered for sliding under and entering within the flared lip portion 7 of outer conductor 12 of cable 5, and for engaging the inner surface of such flared lip.

It will be noted that the threaded surface 129 of outer body 104 is axially inset toward end 128 relative to second clamping surface 108 for allowing second clamping surface 108 to protrude into flared lip 7 of outer conductor 12. Outer body 104 is preferably made of machine-quality brass plated with a coating of either NiTin-6 or silver; alternatively, outer body 104 could be made from aluminum. In preferred embodiments, the outer surface of outer body 104 comprises hexagonal region 138 for allowing a wrench to engage therewith.

As indicated in FIG. 7, as back nut 103 is tightened over first end 126 of outer body 104, first clamping surface 109 and second clamping surface 108 collectively serve to sandwich, and therefore clamp, at least a portion of flared lip 7 of outer conductor 12 therebetween. This clamping action provides good mechanical joinder of coaxial cable 5 to coaxial connector 110. It also forms good electrical contact between outer conductor 12 of cable 5 and outer body 104 of coaxial connector 110.

Figure 9:
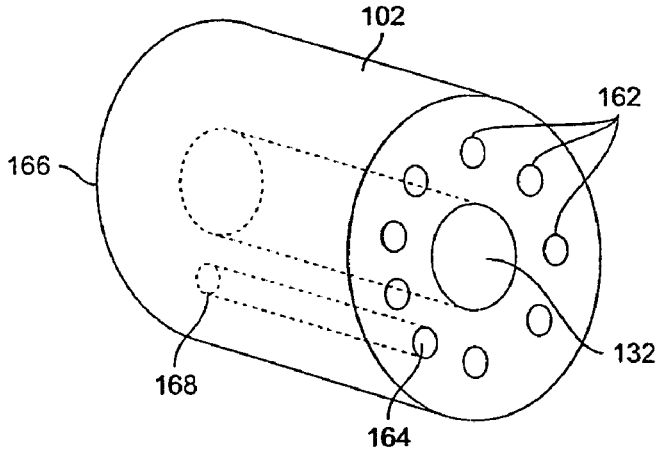
FIG. 9 is a perspective view of a dielectric member that supports the center conductor of the connector within the outer body of the connector.

As shown in FIG. 7, a first dielectric insulator 102 is disposed within central bore 130 of outer body 104. Dielectric 102 has an inner surface defining a central bore 132 extending therethrough along the central axis of outer body 104. Dielectric member 102 is preferably made of TPX® Polymethylpentene polymer; it could also be made from PTFE Teflon® from DuPont. Within FIG. 7, dielectric member 102 appears to have a U-shaped cross-section extending outwardly along its radius. As shown in FIG. 9, dielectric member 102 is preferably solid but a series of radially-spaced holes 162 and 164 are formed therein opening toward first end 126 of outer body 104; such holes help to maintain the characteristic impedance of the transmission path to minimize signal reflections. In FIG. 9, central bore 132 fully extends through dielectric 102, exiting at back wall 166 thereof. However, holes 162 and 164 are blind holes and stop short of back wall 166. For purposes of clarity, the outline of only one hole 164 is shown in dashed lines in FIG. 9; the bottom wall, or end wall, of hole 164 is indicated by reference numeral 168.

Still referring to FIG. 7, center conductor 101 extends through central bore 132 of dielectric member 102 and is supported thereby. Center conductor 101 extends between a first end formed as a compressible female socket 134 and an opposing second end 136 formed as a male pin extending generally within second end 128 of outer body 104. A front nut 148 is rotatably secured about second end 128 of outer body 104; front nut 148 preferably includes an internally-threaded surface 150 for mating with an externally-threaded mating component. Front nut 148 is preferably made of brass plated with a coating of NiTin-6; alternatively, it could be made from aluminum. Front nut 148 is retained on outer body 104 by spring-biased retaining snap ring 158; snap ring 158 is preferably made of unplated brass, or phosphor-bronze. Snap ring 158 is slid into a groove provided on the outer surface of outer body 104 proximate second end 128; front end nut 148 is then slid over second end 128 of outer body 104, compressing snap ring 158 until front nut 148 slides beyond snap ring 158. Snap ring 158 then pops partially out of its groove to retain front end nut 148 on outer body 104.

Reduced diameter grooves 140 are provided on the outer surface of center conductor 101 proximate dielectric member 102, for the purpose of maintaining a relatively continuous characteristic impedance along the signal path. These grooves 140 provide electrical impedance compensation, as the impedance of the connector changes due to the presence of dielectric 102 as compared with air. The compressible female socket 134 is open toward first end 126 of outer body 104. Female socket 134 may initially be a cup shaped member into which longitudinal slots are cut to form resilient fingers for receiving and engaging the exposed end portion of inner conductor 11 of coaxial cable 5. Center conductor 101 is preferably made of tin-bronze alloy, or phosphor-bronze alloy, plated with silver, alternatively, it could be made from berylium copper (BeCu) alloy. While the second end of center conductor 101 is shown as a male pin, it could instead be formed as a female port, as per FIGS. 1 and 2 if desired.

Within FIG. 7, an electrically insulative seizure compressor member 142 is disposed within first end 126 of outer body 104. Seizure compressor 142 preferably has a funnel shape, more preferably a funnel shape with a truncated spout, and includes a first larger diameter end 144 for engaging the flared lip portion 7 of outer conductor 12 of cable 5. The second, smaller diameter end 146 engages the resilient fingers forming compressible female socket 134. As back nut 103 is tightened onto outer body 104, at least a portion of seizure compressor 142 is axially displaced by flared lip portion 7, driven by back nut 103, further into outer body 104, and compresses female socket 134 radially inwardly to seize the exposed portion of inner conductor of coaxial cable 5. Preferably, at least the radially outermost portion of the seizure compressor member 142 is axially displaced, relative to the outer body 104, toward end 128. Seizure compressor member 142 is preferably made of reinforced crystalline thermoplastic polymer such as POM Delrin® acetal resin, which is strong, rigid, has excellent dimensional stability, a low coefficient of friction, has good abrasion and impact resistance, and has low moisture absorption. Alternatively, seizure compressor 142 could be made from 30% glass fiber reinforced polypropylene (PP). As indicated in FIG. 7, seizure compressor member 142 snaps into a groove 160 formed in the inner surface of central bore 130 of outer body 104 proximate first end 126 thereof. Groove 160 is sufficiently longitudinally wide to permit seizure compressor member 142 to be axially displaced therein.

Prior to shipment to a customer, back nut 103 is preferably temporarily affixed to first end 126 of outer body 104 by mutually threading together with the connector at least one turn to secure the parts together for shipment. As in the case of connector 10 (see FIGS. 1–3), prior to installing connector 110, the user cores the end of the cable (i.e., cores out the dielectric foam 13 between the inner conductor 11 and the outer conductor 12), and strips the protective jacket 14 from the end of the coaxial cable 5, so that the exposed length of the center conductor 11, the coring depth of the dielectric foam 13, and the length of the jacket 14 cut back, are all preselected to match the connector. Note that the exposed tip of the inner conductor 11 will protrude beyond the exposed edge of the outer conductor 12. The back nut 103 is then installed over the stripped outer conductor 12. Next, the user flares the outer conductor 12 of the coaxial cable 5 with a flaring tool, and simultaneously removes any adhesive or foam from the inside of the outer conductor. Any foam remaining on the center conductor 11 is removed to ensure good electrical contact. Then the back nut 103 and the first end 126 of the outer body 104 are threaded together to complete the installation.

Those skilled in the art will note that the above-described connector is of extremely simple design and requires a minimal number of components. It will also be noted that the outer conductor 12 of the coaxial cable 5 is directly clamped between the outer terminal 4 (or outer body 104) and back nut 3 (or back nut 103) of the coaxial connector, without requiring additional clamp rings, collars or other like components. Moreover, the embodiment of FIG. 7 also serves to positively seize the inner conductor of the cable. As a result of its simple design, the disclosed connector can be manufactured relatively inexpensively and may be installed to the end of a coaxial cable relatively quickly and reliably.

While the present invention has been described with respect to a preferred embodiment thereof, such description is for illustrative purposes only, and is not to be construed as limiting the scope of the invention. Various modifications and changes may be made to the described embodiment by those skilled in the art without departing from the true spirit and scope of the invention.

The invention claimed is:

1. A coaxial connector for use with a prepared end of a coaxial cable, the coaxial cable including an inner conductor of a first predetermined diameter, a dielectric surrounding the inner conductor, an outer conductor of a second predetermined diameter surrounding the dielectric, and a protective jacket surrounding the outer conductor, the prepared end of the coaxial cable having an end portion of the dielectric removed to expose an end portion of the inner conductor, the prepared end also having an end portion of the protective jacket removed to expose an end portion of the outer conductor, the outer conductor having opposing inner and outer surfaces, the coaxial connector comprising:

a. a back nut having an inner surface defining a central bore extending between first and second ends thereof and including a first annular clamping surface integral therewith and disposed between the first and second ends of the back nut for engaging the outer surface of the outer conductor;

b. a generally tubular outer body having first and second ends and having an inner surface defining a central bore extending therethrough along a central axis between the first and second ends thereof, the first end of said outer body being adapted to be secured to the back nut and having a second annular clamping surface integral therewith for engaging the inner surface of the outer conductor of the coaxial cable;

c. wherein the first and second clamping surfaces collectively are adapted to sandwich an exposed portion of the outer conductor of the coaxial cable therebetween as the back nut is tightened onto the first end of the outer body;

d. a first dielectric disposed within the central bore of the outer body, the first dielectric having a central bore extending therethrough along the central axis of the outer body;

e. a center conductor extending through the central bore of the first dielectric and supported thereby, the center conductor extending between first and second ends, the first end of the center conductor including a compressible female socket opening toward the first end of the outer body for receiving and engaging the inner conductor of the coaxial able; and f. an electrically insulative seizure compressor extending between the female socket and the outer body, the seizure compressor including a first engagement surface for engaging the outer conductor of the coaxial cable and a second engagement surface for engaging the compressible female socket, wherein the back nut axially displaces at least a portion of the seizure compressor toward the second end of the outer body as the back nut is secured onto the first end of the outer body and compresses the female socket to seize the inner conductor of the coaxial cable;

wherein at least a portion of the back nut and at least a portion of the outer body are threadedly matable.

2. The coaxial connector of claim 1 wherein a radially outermost portion of the seizure compressor is axially displaced toward the second of the outer body as the back nut is secured onto the first end of the outer body.

3. The coaxial connector of claim 1 wherein the inner surface of the outer body is provided with a groove adapted to receive at least a part of the seizure compressor therein.

4. The coaxial connector of claim 1 wherein at least a part of the seizure compressor snaps into a groove provided in the inner surface of the outer body.

5. The coaxial connector of claim 1 wherein the back nut drives the outer conductor against the seizure compressor.

6. The coaxial connector of claim 1 wherein the electrically insulative seizure compressor is disposed within the first end of the outer body.

7. The coaxial connector of claim 1 wherein the second end of the center conductor extends generally within the second end of the outer body.

8. The coaxial connector of claim 1 wherein the first end of said outer body is adapted to be releasably secured to the back nut.

9. The coaxial connector of claim 1 wherein the inner surface of the back nut is adapted to slide over the protective jacket of the cable.

10. The coaxial connector of claim 1 wherein a portion of the central bore of the back nut proximate the first end thereof is bounded by an inner wall, and wherein the inner wall has an annular recess formed therein, the coaxial connector further including an O-ring seated within the annular recess to form a seal between the central bore of the back nut and the protective jacket of the coaxial cable.

11. The coaxial connector of claim 1 wherein the first clamping surface formed within the central bore of the back nut is an inwardly-directed annular step.

12. The coaxial connector of claim 11 wherein the exposed portion of the outer conductor of the coaxial cable includes a flared lip, and wherein the inwardly-directed annular step engages the outer surface of such flared lip.

13. The coaxial connector of claim 12 wherein the inwardly-directed annular step includes a beveled surface for engaging the outer surface of such flared lip.

14. The coaxial connector of claim 1 wherein the second clamping surface of the first end of the outer body is tapered for entering within the outer conductor of the coaxial cable and for engaging the inner surface of the outer conductor of the coaxial cable.

15. The coaxial connector of claim 1 further including an o-ring extending about the outer body and adapted to sealingly engage the second end of the back nut when the back nut is tightened onto the first end of the outer body.

16. The coaxial connector of claim 1 further including a front nut rotatably secured about the second end of the outer body, the front nut including an internally-threaded surface for mating with an externally-threaded mating component.

* * * * *